US009915425B2

(12) United States Patent
Roy et al.

(10) Patent No.: US 9,915,425 B2
(45) Date of Patent: Mar. 13, 2018

(54) IGNITER AND FLAME SENSOR ASSEMBLY WITH OPENING

(71) Applicant: Carrier Corporation, Farmington, CT (US)

(72) Inventors: William J. Roy, Avon, IN (US); James F. Bicknell, Brownsburg, IN (US)

(73) Assignee: CARRIER CORPORATION, Farmington, CT (US)

( * ) Notice: Subject to any disclaimer, the term of this patent is extended or adjusted under 35 U.S.C. 154(b) by 702 days.

(21) Appl. No.: 14/510,362

(22) Filed: Oct. 9, 2014

(65) Prior Publication Data

US 2015/0159868 A1 Jun. 11, 2015

Related U.S. Application Data

(60) Provisional application No. 61/914,172, filed on Dec. 10, 2013.

(51) Int. Cl.
*F23M 20/00* (2014.01)

(52) U.S. Cl.
CPC . *F23M 20/005* (2015.01); *F23N 2900/05002* (2013.01); *Y10T 29/49348* (2015.01)

(58) Field of Classification Search
CPC ..... F23Q 9/04; F23Q 7/10; F23Q 9/00; F23N 5/082; F23N 1/022; F23N 5/003; F23N 2900/05002; F24H 9/2085; F24H 1/205; F24H 3/0488; F23M 9/06; F23M 20/005; F23D 14/70; F23D 14/04; Y10T 29/49348; F23C 5/00
USPC ..... 126/116 A; 431/76, 75, 114, 14, 193, 7
See application file for complete search history.

(56) References Cited

U.S. PATENT DOCUMENTS

| | | | | |
|---|---|---|---|---|
| 3,104,697 | A * | 9/1963 | Zarybnicky | F23Q 9/00 431/193 |
| 3,495,925 | A | 6/1968 | Willson | |
| 4,334,855 | A | 6/1982 | Nelson | |
| 4,405,299 | A | 9/1983 | Serber | |
| 4,449,918 | A * | 5/1984 | Spahr | F23N 5/003 236/15 E |
| 4,588,372 | A | 5/1986 | Torborg | |
| 4,645,450 | A | 2/1987 | West | |
| 5,249,954 | A * | 10/1993 | Allen | F23N 5/082 348/83 |
| 5,435,716 | A * | 7/1995 | Joyce | F24H 1/205 122/17.1 |
| 5,556,272 | A * | 9/1996 | Blasko | F23Q 9/04 126/39 E |

(Continued)

FOREIGN PATENT DOCUMENTS

| | | | |
|---|---|---|---|
| EP | 2388522 | A2 | 11/2011 |
| NL | 8403840 | A | 7/1986 |
| WO | 2013076632 | A1 | 5/2013 |

*Primary Examiner* — Alfred Basichas
(74) *Attorney, Agent, or Firm* — Cantor Colburn LLP

(57) ABSTRACT

A burner assembly includes a burner housing having a fuel inlet; a burner for emitting ignited fuel to a heat exchanger; and an igniter and flame sensor assembly mounted to the burner housing, the igniter and flame sensor assembly including an opening therein providing an air path from an exterior of the burner housing to an interior of the burner housing, the opening sized to provide a predetermined drop of carbon dioxide at an outlet of the heat exchanger.

13 Claims, 4 Drawing Sheets

(56) References Cited

U.S. PATENT DOCUMENTS

| | | | | |
|---|---|---|---|---|
| 5,580,238 | A * | 12/1996 | Charles, Sr. | F23M 9/06 126/91 A |
| 5,590,642 | A | 1/1997 | Borgeson et al. | |
| 5,601,071 | A * | 2/1997 | Carr | F23N 1/022 126/110 R |
| 5,971,745 | A | 10/1999 | Bassett et al. | |
| 6,242,263 | B1 * | 6/2001 | Faber | F01N 11/00 422/94 |
| 6,282,910 | B1 | 9/2001 | Helt | |
| 6,866,202 | B2 | 3/2005 | Sigafus et al. | |
| 7,241,135 | B2 | 7/2007 | Munsterhuis et al. | |
| 8,523,560 | B2 | 9/2013 | Anderson et al. | |

* cited by examiner

IGNITER AND FLAME SENSOR ASSEMBLY WITH OPENING

CROSS-REFERENCE TO RELATED APPLICATIONS

This application claims the benefit of U.S. provisional patent application Ser. No. 61/914,172, filed Dec. 10, 2013, the entire contents of which are incorporated herein by reference.

BACKGROUND

The subject matter disclosed herein relates to heating systems. More specifically, the subject matter disclosed herein relates to burners for residential and/or commercial heating systems.

Residential and/or commercial heating systems commonly employ a furnace to heat supply air. Existing furnaces can suffer from restricted airflow about the igniter of a furnace burner. Poor airflow in the burner assembly may result in positive pressure spikes at ignition, leading to acoustic disturbances. Additionally, poor airflow can result in the igniter temperature exceeding desirable limits.

SUMMARY

An exemplary embodiment includes a burner assembly including a burner housing having a fuel inlet; a burner for emitting ignited fuel to a heat exchanger; and an igniter and flame sensor assembly mounted to the burner housing, the igniter and flame sensor assembly including an opening therein providing an air path from an exterior of the burner housing to an interior of the burner housing, the opening sized to provide a predetermined drop of carbon dioxide at an outlet of the heat exchanger.

Another exemplary embodiment includes a method of forming an opening in an igniter and flame sensor assembly including a mounting plate mounted to a burner housing of a furnace having a heat exchanger, the opening providing an air path from an exterior of the burner housing to an interior of the burner housing, the method including operating a furnace; measuring carbon dioxide at an outlet of the heat exchanger to obtain an initial carbon dioxide level; forming an initial opening in the mounting plate; operating the furnace; measuring carbon dioxide at an outlet of the heat exchanger to obtain a measured carbon dioxide level; determining if the measured carbon dioxide level is less than the initial carbon dioxide level by a predetermined amount; and if the measured carbon dioxide level is not less than the initial carbon dioxide level by the predetermined amount, incrementally increasing the size of the opening.

These and other advantages and features will become more apparent from the following description taken in conjunction with the drawings.

The detailed description explains embodiments of the invention, together with advantages and features, by way of example with reference to the drawings.

DETAILED DESCRIPTION

Figure 1:
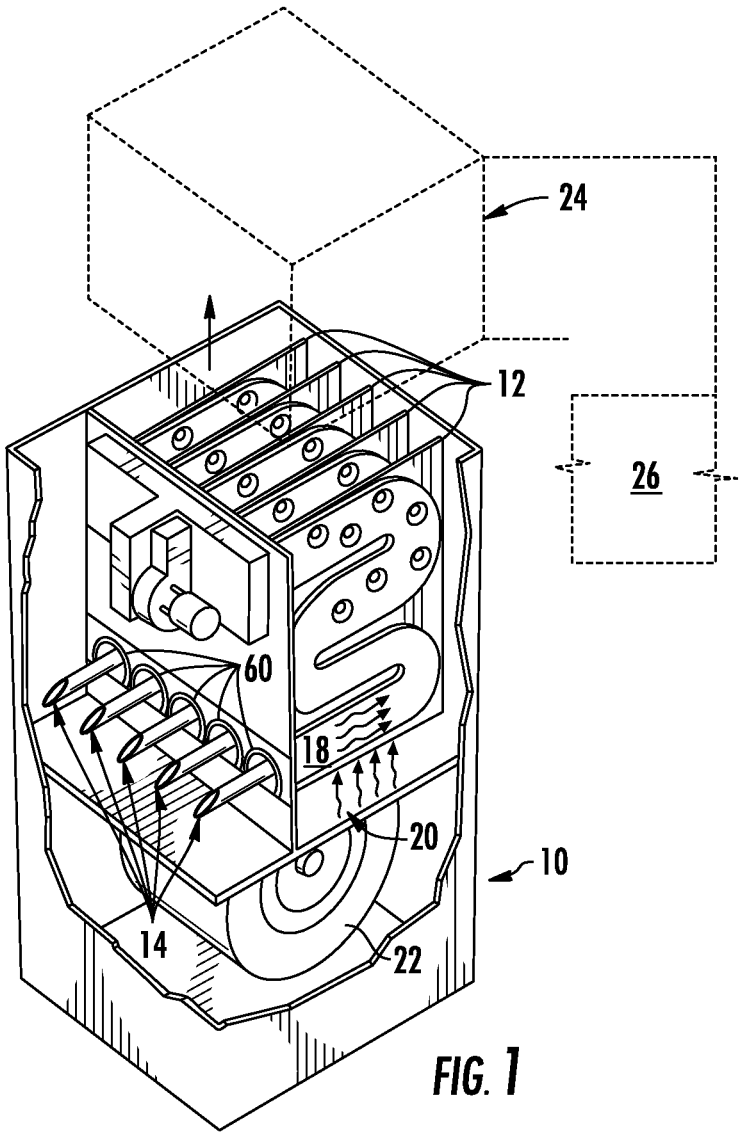
FIG. 1 depicts a furnace in an exemplary embodiment.

FIG. 1 depicts a furnace 10 in an exemplary embodiment. Furnace 10 includes a heat exchanger 12 with one or more burners 14 aligned with respective burner openings 60 in heat exchanger 12. In some embodiments, the burners 14 are located substantially within the heat exchanger 12, while in other embodiments, the burners 14 may abut the heat exchanger 12. In still other embodiments, the burners 14 offset a distance from the heat exchanger 12, but are aligned with the burner openings 60 such that, once ignited, the burners 14 radiate hot flue gas 18 into the heat exchanger 12, thermal energy from which is transferred to the heat exchanger 12 structure. The thermal energy is then dissipated from the heat exchanger 12 via a flow of air 20 driven across the heat exchanger 12 by, for example, a blower 22. The heated flow of air 20 is delivered through one or more ducts 24 to provide heating to a space 26, such as a room or a building.

Figure 2:
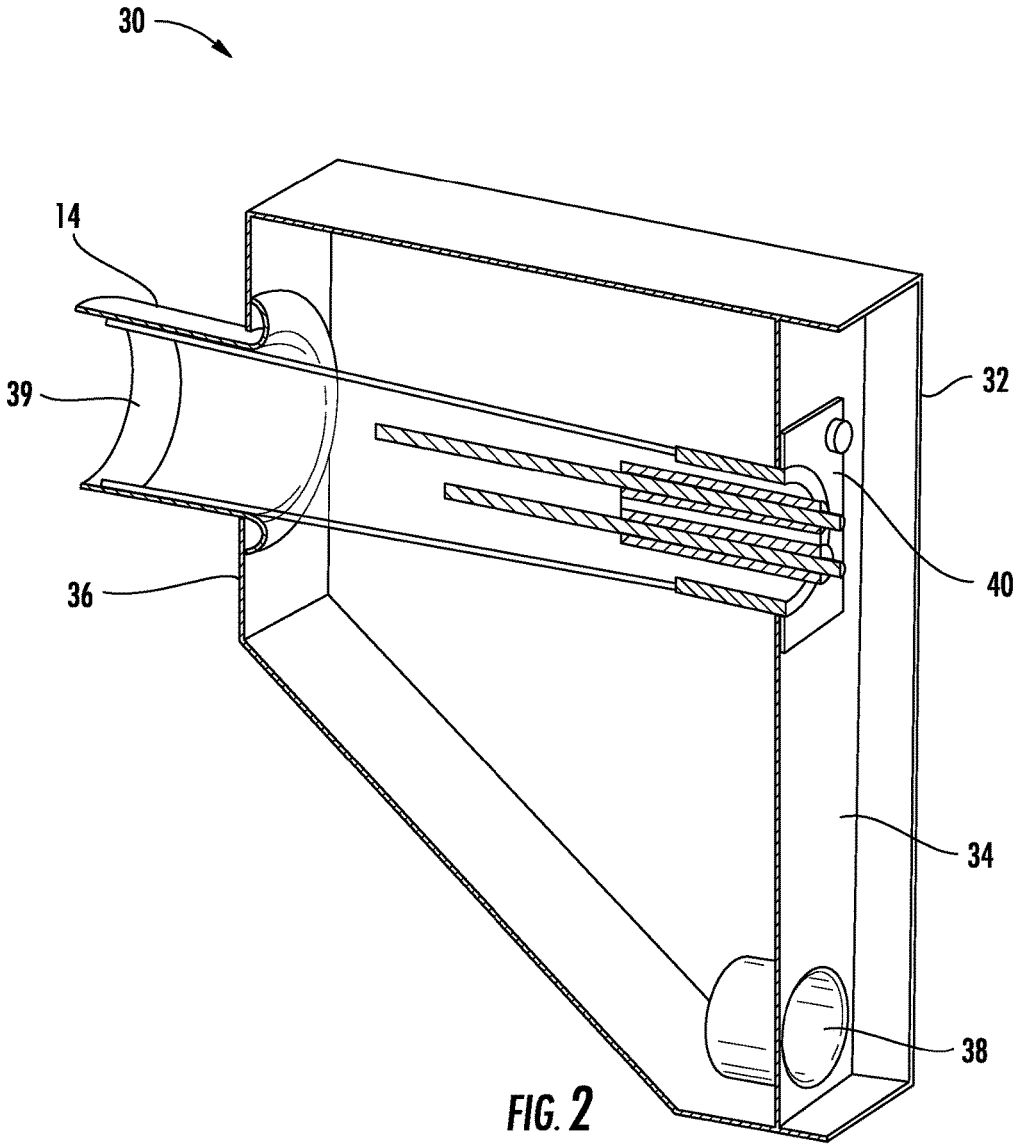
FIG. 2 depicts a burner assembly in an exemplary embodiment.

FIG. 2 depicts a burner assembly 30 in an exemplary embodiment. Burner assembly 30 includes a burner housing 32 having an inlet wall 34 and an exit wall 36. A fuel inlet 38 provides a location for an air/fuel mixture to enter burner housing 32. An igniter and flame sensor assembly 40 is mounted in an opening in inlet wall 34. The igniter and flame sensor assembly 40 is described in further detail herein with reference to FIG. 3. A burner 14 extends outwardly from exit wall 36. In operation, a fuel/air mix admitted at fuel inlet 38 travels through burner 14 and is ignited by the igniter of the igniter and flame sensor assembly 40. The resultant hot flue gas is emitted through burner outlet 39, into heat exchanger 12 as described above with reference to FIG. 1.

Figure 3:
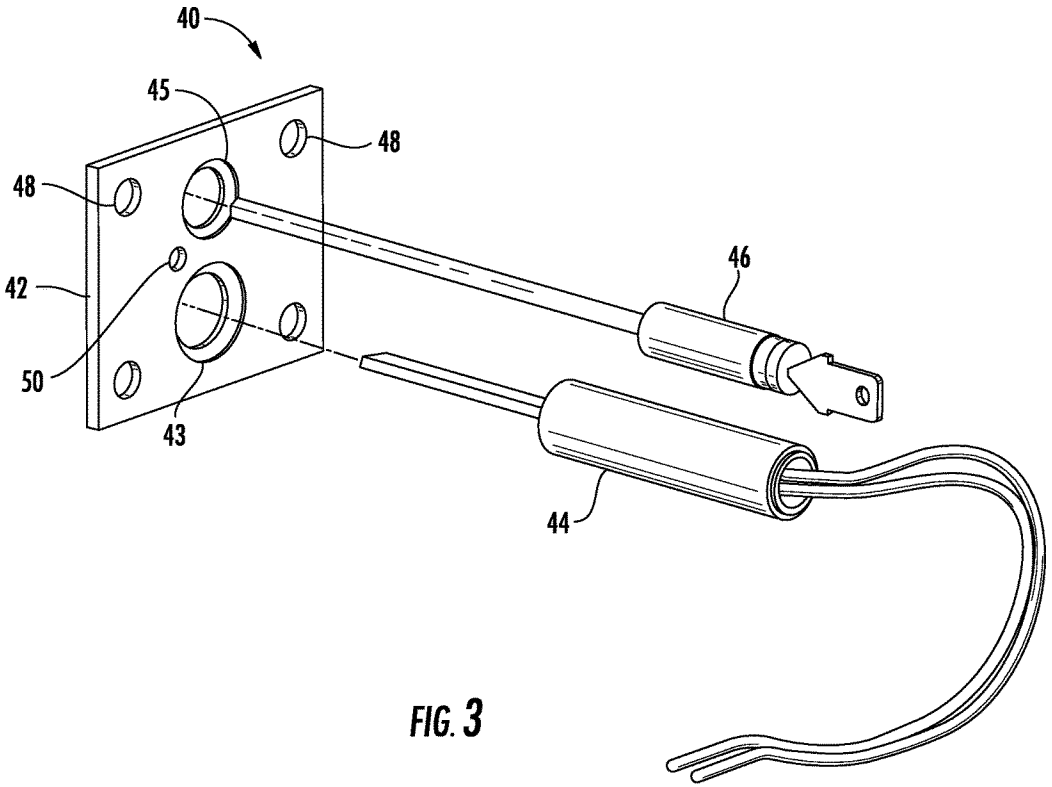
FIG. 3 depicts an igniter and flame sensor assembly in an exemplary embodiment.

FIG. 3 depicts an igniter and flame sensor assembly 40 in an exemplary embodiment. The igniter and flame sensor assembly 40 includes a mounting plate 42 having a first aperture 43 to mount and support an igniter 44. Mounting plate 42 includes a second aperture 45 to mount and support a flame sensor 46. Mounting plate 42 includes a plurality of mounting holes 48 to secure the mounting plate to the rear inlet 34 of the burner housing 32.

Mounting plate 42 also includes an opening 50 positioned between the first aperture 43 and second aperture 45, although the location of opening 50 may vary in other embodiments. Opening 50 provides an air path for the ingress of air from an exterior of the burner housing 32 to an interior of the burner housing 32. Opening 50 is sized to enhance operation of furnace 10, and meet standards. In exemplary embodiments, opening 50 is of sufficient size (e.g., diameter) so as to provide a visual confirmation of flame presence, as required by ANSI Z21. 47, for residential applications. In exemplary embodiments, opening 50 is sized to reduce internal pressure in burner housing 32, so as to provide pressure relief upon ignition and reduce acoustic disturbances. In exemplary embodiments, opening 50 is sized to provide cooling airflow for igniter 44.

The size of opening 50 is selected to provide one or more of a visual confirmation of flame presence, reduced internal pressure in burner housing 32 and cooling airflow for igniter 44. The diameter of opening 50, however, cannot be so large that excessive air is introduced into burner housing 32, disrupting the air/fuel mix ratio. In an exemplary embodiment, the diameter of opening 50 is about 3.2 millimeters, plus or minus about 0.5 millimeters. However, embodiments are not limited to this diameter, nor are embodiments limited to circular openings. More generally, the size of opening 50 may be characterized as being of sufficient size to provide a predetermined drop in carbon dioxide level at an outlet of heat exchanger 12. The predetermined drop in carbon dioxide present at an outlet of heat exchanger 12 is about 0.1% to about 0.2%, when opening 50 is present, when compared to operating furnace 10 without opening 50.

Figure 4:
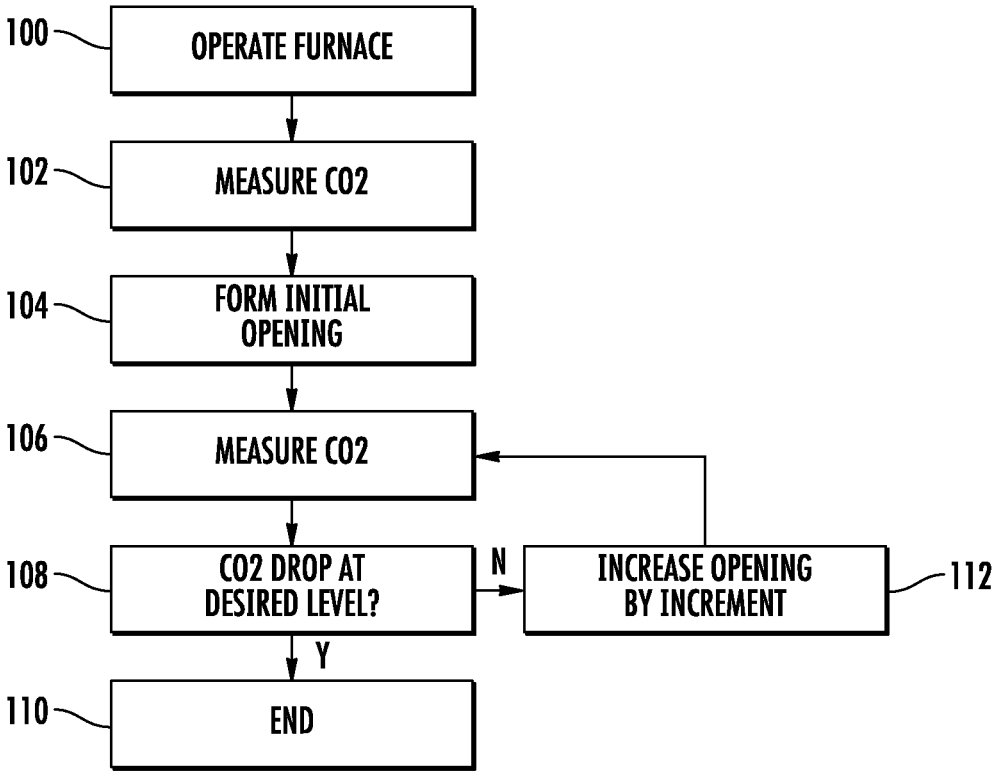
FIG. 4 is a flowchart of a process for forming an opening in an exemplary embodiment.

FIG. 4 is a flowchart of a process for forming opening 50 in an exemplary embodiment. The process begins at 100 where the furnace 10 is operated. At 102, the level of carbon dioxide at the outlet of heat exchanger 12 is measured (e.g., with a sensor) to establish an initial carbon dioxide level. At 104, an initial opening 50 is formed is in mounting plate 42. The initial opening may be relatively small (e.g., 1 millimeter). At 106, the furnace is operated and the level of carbon dioxide at the outlet of heat exchanger 12 is measured. At 108, it is determined if the level of carbon dioxide at the outlet of heat exchanger 12 has dropped by a predetermined level from the initial carbon dioxide level (e.g., about 0.1% to about 0.2%). If the level of carbon dioxide at the outlet of heat exchanger 12 has dropped by the predetermined level, then the process ends at 110. If the level of carbon dioxide at the outlet of heat exchanger 12 has not dropped by the predetermined level, then flow proceeds to 112. At 112, opening 50 is incrementally increased in size (e.g., by 0.5 millimeter) and flow returns to 106. The process continues until opening 50 is sized sufficiently to reduce the level of carbon dioxide at the outlet of heat exchanger 12 by the predetermined level.

Embodiments provide a number of advantages. Opening 50 provides a visual confirmation of flame presence, reduces internal pressure in the burner housing and provides cooling airflow for the igniter. Opening 50 is sized to achieve one or more of these advantages, while not admitting excessive air into the burner housing.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A burner assembly comprising:

a burner housing having a fuel inlet;

a burner for emitting ignited fuel to a heat exchanger;

an igniter and flame sensor assembly mounted to the burner housing, the igniter and flame sensor assembly including a mounting plate supporting an igniter and a flame sensor, the mounting plate including an opening formed therein providing an air path from an exterior of the burner housing to an interior of the burner housing, the opening sized to provide a predetermined drop in carbon dioxide at an outlet of the heat exchanger.

2. The burner assembly of claim 1 further comprising: an igniter mounted to the mounting plate.

3. The burner assembly of claim 2 further comprising: a flame sensor mounted to the mounting plate.

4. The burner assembly of claim 3 wherein: the opening is positioned between the igniter and the flame sensor.

5. The burner assembly of claim 1 wherein: the predetermined drop of carbon dioxide is about 0.1% to about 0.2%.

6. The burner assembly of claim 1 wherein: the opening provides a visual confirmation of flame presence in the burner housing.

7. The burner assembly of claim 1 wherein: the opening reduces acoustic disturbances in the burner housing.

8. The burner assembly of claim 1 wherein the opening is sized to provide the predetermined drop in carbon dioxide at the outlet of the heat exchanger as compared to the igniter and flame sensor assembly not including the opening.

9. A method of forming an opening in an igniter and flame sensor assembly including a mounting plate mounted to a burner housing of a furnace having a heat exchanger, the opening providing an air path from an exterior of the burner housing to an interior of the burner housing, the method comprising:

operating a furnace;

measuring carbon dioxide at an outlet of the heat exchanger to obtain an initial carbon dioxide level;

forming a permanent initial opening in the mounting plate;

operating the furnace;

measuring carbon dioxide at an outlet of the heat exchanger to obtain a measured carbon dioxide level;

determining if the measured carbon dioxide level is less than the initial carbon dioxide level by a predetermined amount; and if the measured carbon dioxide level is not less than the initial carbon dioxide level by the predetermined amount, incrementally, permanently increasing the size of the opening.

10. The method of claim 9 wherein: the predetermined amount is represented as a percentage of the initial carbon dioxide level.

11. The method of claim 10 wherein: the percentage of carbon dioxide level is about 0.1% to about 0.2%.

12. The method of claim 9 wherein: the opening provides a visual confirmation of flame presence in the burner housing.

13. The method of claim 9 wherein: the opening reduces acoustic disturbances in the burner housing.

* * * * *